United States Patent [19]

Ferenczi et al.

[11] Patent Number: 4,923,529

[45] Date of Patent: May 8, 1990

[54] EQUIPMENT FOR CONTINUOUS HEAT TREATMENT OF TUNGSTEN FILAMENTS WOUND ON MOLYBDENUM CORES

[75] Inventors: Tibor Ferenczi, Debrecen; László Kovács, Hajdúiböszörmény; Attila Szathmari, Debrecen, all of Hungary

[73] Assignee: Tungsram Részvénytársaság, Budapest, Hungary

[21] Appl. No.: 258,712

[22] Filed: Oct. 17, 1988

[30] Foreign Application Priority Data

Oct. 22, 1987 [HU] Hungary ..... 4733/87

[51] Int. Cl.[5] ..... C21D 9/52

[52] U.S. Cl. ..... 148/20.3; 148/154; 266/117; 266/119

[58] Field of Search ..... 266/117, 119; 148/20.3, 148/154

[56] References Cited

U.S. PATENT DOCUMENTS

| | | | |
|---|---|---|---|
| 2,881,104 | 4/1959 | Jones et al. | 148/133 |
| 3,165,427 | 1/1965 | Hurst | 148/133 |
| 3,574,005 | 4/1971 | Rudd | 148/154 |
| 3,682,723 | 8/1972 | Riekkinen | 148/154 |

*Primary Examiner*—Upendra Roy
*Attorney, Agent, or Firm*—Spencer & Frank

[57] ABSTRACT

The invention relates to continuous heat treatment of coiled tungsten filaments wound onto molybdenum cores, in the course of which said filament is passed first through a humid hydrogen atmosphere of about 1300° C. then through a dry hydrogen atmosphere of a temperature of about 1700° to about 1850° C. The method complying with the invention is characterized by transfer times of the coiled tungsten filaments to be heat-treated through heating zones lying in the range of about 3 to about 7 seconds, preferably about 5 seconds, but the duration of passing through the 1700° to 1850° C. high-temperature is at most 7 seconds. The invention also covers the equipment suitable for accomplishing the method, consisting of two high-melting metallic heating tubes, an inventing wheel, a spiral winding/unwinding device, and a temperature sensing and controlling unit. The equipment complying with the invention is also characterized by the tungsten spiral filaments passing in axial direction through heating tubes of low thermal inertia and made of some low-melting metal directly heated with electric current supplied by an electric power unit, temperature control of which is accomplished by electronically controlling the passed-through current, based on measuring the resistance of the heating tube.

10 Claims, 2 Drawing Sheets

EQUIPMENT FOR CONTINUOUS HEAT TREATMENT OF TUNGSTEN FILAMENTS WOUND ON MOLYBDENUM CORES

BACKGROUND OF THE INVENTION

The invention relates to the heat treatment of tungsten filaments would on molybdenum cores, wherein the spirals are drawn through a humid hydrogen atmosphere of temperature range about 1300° C., then through a similar, but dry atmosphere of temperature range about 1700° C. to 1850° C. The invention refers also to an equipment for accomplishing the proposed method, the equipment formed of two heating tubes made of high-melting metal, an inflection wheel, a spiral winding/unwinding device, inlet means for introducing gas and cooling, current leads, as well as a temperature sensing and controlling unit.

In the technology of manufacturing light sources the step of preparing filaments from spirally coiled elements covers also the important process of heating, i.e. heat treatment of secondary tungsten coils wound over molybdenum core wires. The heating technology has two important phases, namely the degraphitizing heat treatment (for purifying) and the fixing of the filament on the molybdenum core wire (heat treatment for fixing).

According to prior art practice, purifying heat treatment is performed in a humid hydrogen atmosphere in the temperature range of about 1100° C. to about 1300° C., in the course of which, by the oxygen content of water vapour, the graphite used as lubricant in wire-drawing is burnt off. The fixing heat treatment applied after the filament-shaping operation for fixing the geometrical shape of the filament takes place at a temperature of about 1600° C. in dry hydrogen.

During the above mentioned operations the drawing speed should be such as to provide for a duration of approximately 20 seconds for the heat treatment (i.e. the time when each individual element of the filament passes through the heating space). This results, however, in an extremely low drawing speed (0.01 m/s in a heating space of 200 mm length) and consequently in a very low productivity.

The coiled filament may be kept at a temperature of about 1600° C. for a more prolonged time without becoming brittle, whereas above this temperature, with heat-treating times lying in the order of magnitude of a minute, primary recrystallization takes place in the tungsten filament. the filament becomes brittle and unsuitable for being installed. Moreover, above this temperature the molybdenum core also becomes brittle. On the other hand, the heat treatment can only be considered successful is neither the molybdenum core, nor the tungsten filament become brittle, and after withdrawal of the core, the filament retains its shape.

The disadvantage of the methods of the art described above is the high energy demand (in electric power and hydrogen) and relatively low speed of performance, i.e. the unsatisfactory productivity.

OBJECT OF THE INVENTION

In the course of developing the present invention the aim has been to provide an equipment and method for the heat treatment of filaments, whereby the energy demand of their manufacture is reduced with simultaneous improvement of the productivity.

Making use of the investigations and manufacturing experience the invention is based on the recognition that the two important heating parameters, viz. temperature and duration (the time period of applying the temperature), may be converted into each other between certain limits. It has been found that when considerably increasing the heating temperature, the duration of heating may be shortened, and this recognition opens the possibility of developing a method of much shorter duration than the known methods of the art and still satisfying the requirements. It has been established that in a tungsten the relaxation of the mechanical stresses takes a period of 5 seconds at a temperature of 1800° C. this is too short to permit the molybdenum core and the tungsten filament to become brittle. So, with a heating zone of 0.5 m length a considerably higher drawing speed of 0.1 m/s can be adopted. In this case the time the filament travels through the heating space can no longer vary within wide limits. The time may only be of well-defined duration, this being the function of overtemperature of heating by which the basic level of 1600° C. is exceeded. With shorter times of travelling the mechanical stresses caused by the spiral-forming process of forming the filament are not fully relieved, so that after withdrawing the molybdenum core, the filament tends to "kink up", whereas with longer times the brittleness mentioned above arises.

This problems has been solved by the method complying with the invention and by the special quick-heating device proposed by the invention permitting implementation of the method, according to which in stationary conditions the conventional basic temperature is applied as heating temperature, whereas simultaneously with the start of drawing the spiral through the heating space (at a speed determined by the considerations outlined above), the filament assumes a temperature increasing to the required higher value with a time constant of about 80 ms. After reaching such a higher heating temperature, the stability of temperature, within a tolerance of +20° C. is ensured by a precision digital control system. Should the drawing cease for any reason, the temperature is cooled back to the basic value of temperature at a speed similar to that of heating-up.

Accomplishment of the task has been enabled by a low-inertia heating arrangement, the microprocessor-based signal and data processing system, and the quick and high-precision temperature measurement, by which—through application of power control purposefully combined with digital PI regulation—a rapid and overshot-free response to temperature variations and a high degree of stability during constant-temperature operation are achieved.

Thus, the invention relates to a method for continuous heat treatment of tungsten filaments wound on molybdenum cores, in the course of which the filament is drawn first through a humid hydrogen atmosphere of about 1500° C. temperature then through a dry hydrogen atmosphere of about 1700° to 1850° C. temperature. The method proposed by the invention is characterized by a 3 to 7 s, preferably 5 s transit time of tungsten filaments through the heating heat zones but the transit time through the high-temperature zone of about 1700° to about 1850° C. temperature is at most 7 s (seconds).

The equipment according to the invention comprises two heating tubes made of some high-melting metal, an inverting wheel, a winding/unwinding device for preparing a filament, as well as a temperature measuring and regulating unit. The equipment according to the invention is characterized by making the tungsten filament pass in an axial direction through heating tubes of low thermal inertia, made of some high-melting metal and directly heated by electric current passed through them, said heating tubes being heated up gradually by the electric power unit in stationary condition of the tungsten filament to full temperature range in the purifying stage, and only up to basic temperature range in the fixing stage, whereas—at starting—said heating tubes are heated with a small time constant up to the starting temperature increased by the overtemperature, finally, on stopping of the tungsten filament, the power unit cools back to basic temperature range with similarly rapidity; the quick and direct temperature measurement of the heating tubes is achieved by evaluating their electric resistance, the latter being utilized, on the one hand, for controlling the electric power unit after processing the data in an electronic unit and, on the other hand, for displaying the values of temperature; the purifying and fixing heat treatments are performed under a common hood in such a way that humid hydrogen is led directly into the heating tube located in the first heating space, whereas dry hydrogen gas is fed into the heating tube located in the second heating space, the two gases of differing humidity being mixed in said hood only, the latter being closed at its top, permitted by leading the coiled tungsten filament out at the bottom of the hood and by introducing a change in its direction.

BRIEF DESCRIPTION OF THE DRAWINGS

A detailed description of the invention is given in the following, referring to the attached drawings including figure listed here below showing some preferred embodiments of the proposed equipment. In the drawings

DETAILED DESCRIPTION OF THE PREFERRED EMBODIMENTS

Figure 1:
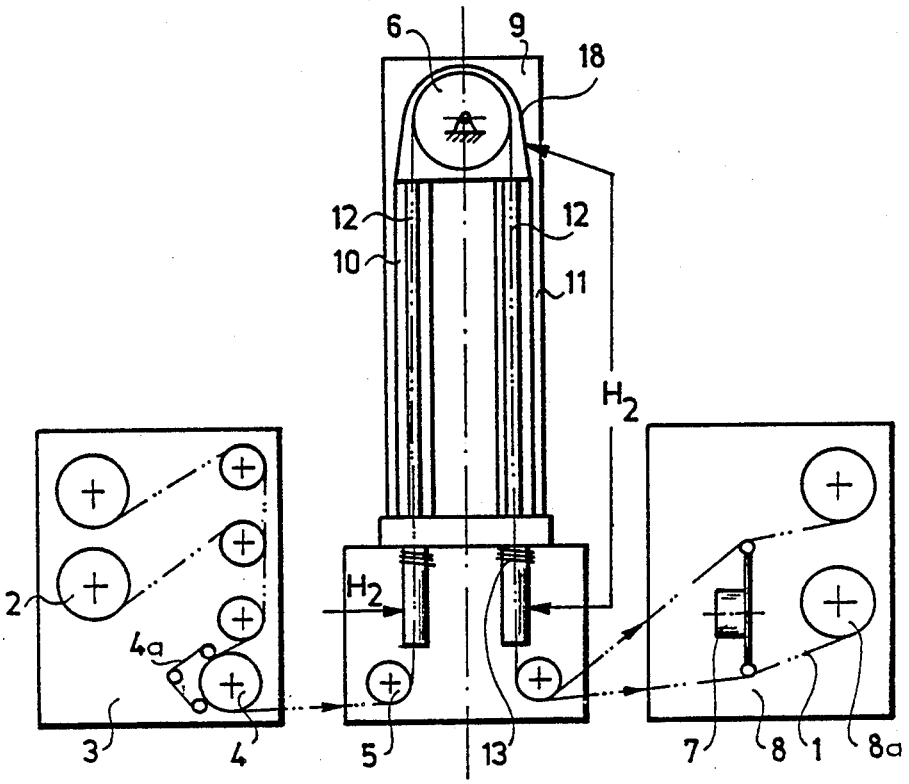
FIG. 1 is a sketch showing the heating equipment complying with to invention.

In the heating equipment (FIG. 1) according to the invention a coiled tungsten filament 1 to be heated is located on a spool 2 arranged on an unspooling unit 3, transferred by a forwarding cylinder 4 and by a forwarding strap 4*a*. The forwarding cylinder 4 and the forwarding strap 4*a* ensure constant transfer speed of the two coiled tungsten filaments 1. The tungsten filament 1 is advanced to the spool 8*a* located on an winding-up unit 8 through inverting wheels 5, 6 and a guide assembly 7.

The degraphitizing and fixing heating step mentioned earlier takes place in heating spaces 10, 11 advantageously accommodated under a common hood 9. The protective atmosphere is directly fed into heating tubes 12 as shown in FIG. 1; into the heating tube 12 located in the heating space 10 humid hydrogen, into the heating tube 12 in the heating space 11 dry hydrogen is introduced. The gases flowing out of the heating tubes mix in hood 9.

With usual wire transfer of conventional designs the heating space cannot be sealed off entirely, because the coiled filaments have to be brought out at the top part of the hood 9. This results in an excessive protective gas consumption, because intensive escape of hydrogen gas lighter than air takes place along the spiral filament. In the arrangement adopted by the present invention the coiled filament is led out at the bottom part of the hood 9, by introducing a change in the direction of the filament, permitting the use of a hood closed at the top.

In that case the hydrogen gas can only escape at the bottom of the hood after having fully filled the space of the hood. With this method small volume of make-up protective gas will only be required and the ambient consumed protective gas per filament is reduced by one order of magnitude.

Another advantage of using a hood closed from above is associated with a possible outage of hydrogen supply, since no air can gain access into the hood 3 and, although the heating tubes continue to glow for some time, no explosion can occur.

Linear thermal expansion of the heating tubes 12 is compensated and their straightness is ensured by spanner springs 13.

Figure 2:
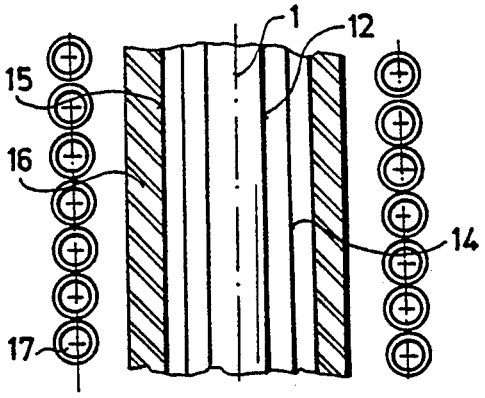
FIG. 2 shows a diagram of the setup of heating spaces and FIG. 3 illustrates a preferred block diagram of the temperature control realised in the heating equipment of the invention.

The internal arrangement of the heating spaces 10, 11 is shown in FIG. 2. The heating tubes 12 are surrounded by two heat reflecting metallic mirrors 14, 15, a ceramic tube 16 and a cooling coil 17. The heat reflecting metallic mirrors 14, 15 and the ceramic tube 16 serve for reducing the share radiation of thermal energy radiated by the equipment. When drawing-in or redrawing-in a coiled tungsten filament, the hood 9 need not be raised, since the heating tubes 12 and a guide plate 18 provide a closed route for the draw-in tape, so that no scavenging with nitrogen is required.

The heating tube 12 is made of a high-melting metal, preferably of a molybdenum plate heated directly by passing electric current through it.

The coiled tungsten filament 1 drawn through the heating tube 12 in axial direction is heated through thermal radiation, gradually approaching the temperature of the heating tube 12. The time constant of this heating process is a function of the filament diameter. The travelling speed of the coiled tungsten filament 1 is selected so that the distance covered by it in a period of a few multiples of the time constant is short with respect to the length of the heating tube 12. This requirement is fulfilled with the speed mentioned above.

Figure 3:
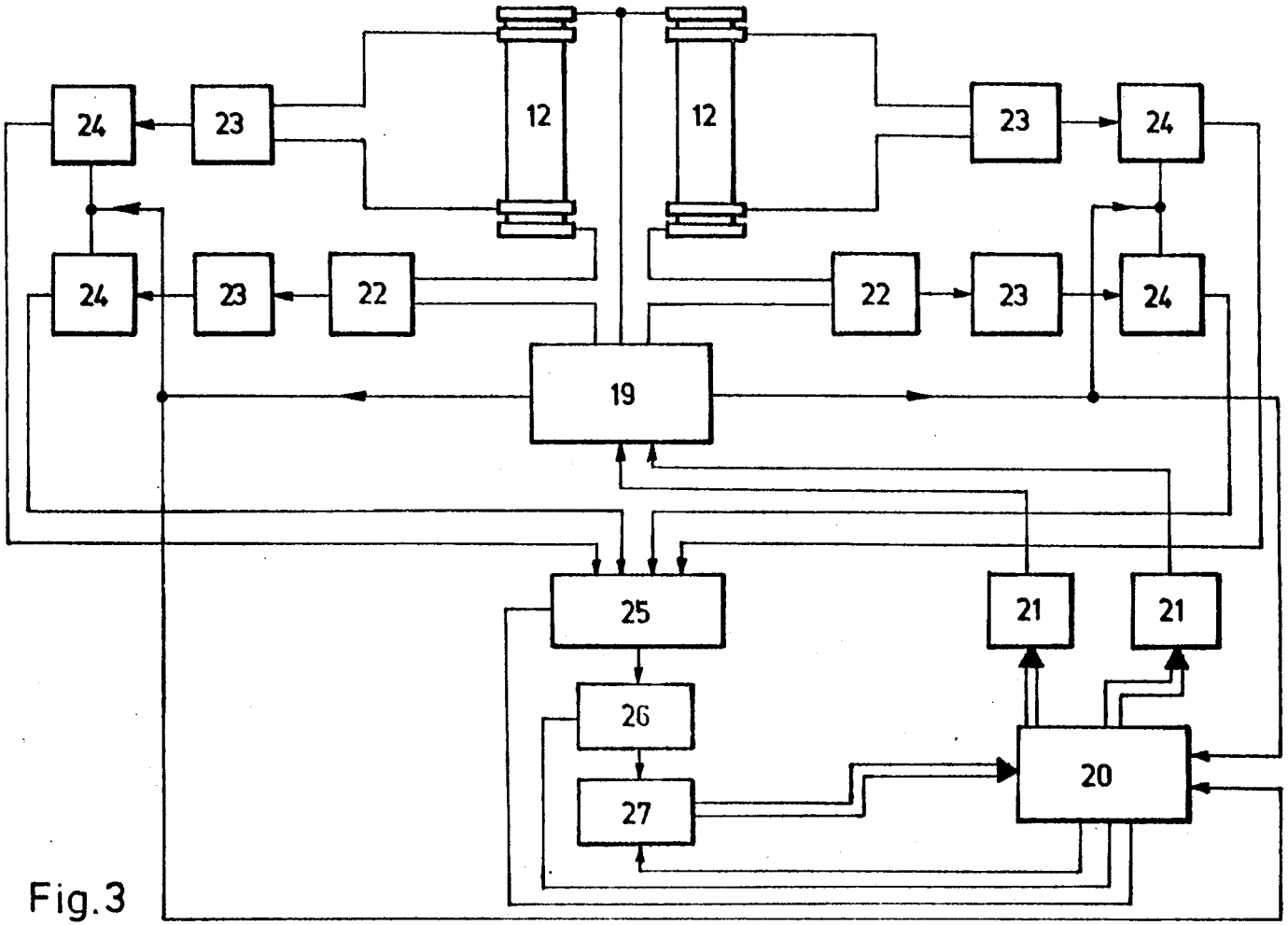

FIG. 3 shows the block diagram of the temperature regulation system of the quick-heating equipment forming the object of the invention.

The electric power fed into the heating tube 12 is provided by a power unit 19 preferably composed of thysistor-type switching elements, the ignition of which is controlled by microprocessor system 20 through a D/A converter 21.

The measurement of the temperature of the coiled tungsten filament is rendered possible by the condition that it assumes with good approximation of the temperature of the heating tube 12 after covering the heating-up distance. Therefore it is sufficient to keep the material of the heating tube 12 at the given temperature. For the purpose of temperature measurement the extremely high temperature dependence of the electric resistance of the heating tube 12 is utilized (e.g. at 1700° C. the resistance exceeds about ten times that which is measured at room temperature).

The electric resistance is determined by simultaneous evaluation of the current flowing through the heating tube 12 and the voltage appearing across a given section of it.

At the output of a current transformer unit 22 a voltage proportional to the heating current appears, which is applied to an absolute-value forming unit 23. The integral of the absolute value of the signal taken through one cycle of the network frequency is provided by the output of an integrator 24, the signal of which is sampled through an analogue demultiplexer 25 by a sample and hold circuit 26, this information being fed into the microprocessor system 20. The voltage is measured across two points of the heating tube 12, excluding the lead-in points of current in order to eliminate the voltage of about 0.5 to 1 volt appearing across the contact resistance of connections having no relation with the temperature of the heating tube 12. After a similar signal processing, the voltage is then applied to the microprocessor system 20.

Instead of "continuous" integration, by performing integration over a period corresponding to one cycle of the network frequency, the signal appearing at the input of an A/D converter 27 truly follows the actual value of the output signal of the current-transformer unit 22, so that the knee-point frequency of the transfer function of that term will be higher than that which would be obtained in the case of continuous integration, resulting in a higher loop amplification and a more rapid response of regulation in the entire system. Thus, the heating tube 12 is not only a heating element, but a temperature sensor as well, permitting inertia-free measurement of the actual mean value of the longitudinal temperature distribution.

The control tasks of heating the two tubes are performed alternately by the control system. The electric resistance is obtained by dividing the magnitude proportional to the voltage with that proportional to the current. Dividing this result by the previously measured resistance of the "cold" tube, the resistance ratio ($\lambda$) is obtained that may be regarded with good approximation as a linear function of temperature in the given range. After calculating the relation $T=T_O+a(\lambda-1)$ the temperature is displayed, this value being, at the same time, equal to the pilot signal required for the control. The required set value in ° C. is adjusted by digital setting switches. From the disposing signal representing the difference between the two values the intervening signal is generated, preferably by means of digital PI algorithm, providing the control signal of the power unit through D/A converter 21.

On starting the heating, the heating tubes 12 are gradually heated up to the basic temperature of about 1600° C., in order to prolongate the service life of the heating tubes 12. On starting the drawing-through, the temperature is increased suddenly by applying a power impulse of given magnitude on the heating tube 12. As a consequence, the heating tube 12 assumes a temperature lying in the vicinity of the value increased by the overtemperature. Then, by means of the PI algorithm, the temperature is regulated to the value adjusted on the digital setting switch. In case of jamming the filaments, filament breaking, exhaustion of the reel the drawing-through process stops, and the system quickly causes the temperature to recede to its basic value. This recession takes place suddenly to the basic level, from here on its goes over to a gradual reduction of the temperature. Since two filaments can pass simultaneously the heating tube 12, in the case when only one filament is heated the mentioned fault monitoring of the missing filament can be disconnected. The individual heating zones may be operated separately under manual control. Now each power unit 19 can be controlled by means of a helical potentiometer, but also in this case the temperature will be automatically reduced to and maintained at basic level by the electronic control.

On outage of hydrogen, nitrogen, cooling water supply, as well as in the case of an ascent of the hood 9, the power supply to the heating tubes is interrupted and the drawing-through of the filaments is stopped. In addition, with the ascent of the hood 9 the supply of hydrogen is shut-off and the heating system is scavenged by nitrogen gas.

Before heating is started, measurement of cold resistance of the heating tube 12 may be activated by pressing the cold-resistance push-button, in the course of which voltage is applied to the heating tube 12 by the power unit 19 for a period of about 40 ms, during which the temperature rise of the heating tube 12 is negligible.

In addition to the information mentioned above by measuring the value of cold resistances elongation and ageing of the heating tube 12 can be traced and the tube be replaced on reaching a predetermined value.

The equipment can be calibrated by means of pyrometric measurement, pressing the calibrating push-botton, and adjusting the modified temperature value on the digit setting switch, with the help of which the value of the coefficient appearing in the formula for calculating the temperature is modified by the proposed equipment.

What we claim is:

1. An equipment for continuous heat treatment of coiled tungsten filaments wound on molybdenum cores, wherein a coiled tungsten filament wound over a molybdenum core is passed in axial direction through heating tubes of low thermal inertial made of appropriate high-melting metal and heated by direct conduction of electric current for carrying out a purifying heating step at lower and a fixing heating step at high temperature range, said heating tubes being continuously heated by a power unit in stationary condition of said coiled tungsten filament, up to full temperature during the period of purifying heating, but only up to basic temperature during the period of fixing heating, whereas at starting the power input of heating is increased to raise the temperature of the heating tube up to heating temperature exceeding the mentioned full temperature by a certain overtemperature, and on stopping of tungsten spiral filament the power unit cools down to basic temperature in a similar short time, the rapid and direct measurement of the temperature of the heating tubes being performed by evaluating their electric resistance and being utilized, after processing in an electronic unit, for controlling, on the one hand, the power unit, and the other hand, for displaying the temperature, the purifying and fixing heating process taking place under a common hood by feeding humid hydrogen gas directly into the heating tube accommodated in the first heating space, and feeding dry hydrogen gas directly into the heating tube accommodated in the second heating space and permitting the two gases of different humidity to mix in said hood only, said hood being closed from above, since the tungsten spiral filament is led out through the open bottom of the hood, after introducing a change in the forwarding direction of said filament.

2. The equipment as set forth in claim 1, characterized by the heating tubes performing at the same time the temperature sensor function and utilizing the heating current supplied by the power unit as measuring current.

3. The equipment as set forth in claim 1, characterized by measuring the voltage drop following from said heating current on the heating tube between two points of the latter which are independent of the lead-in terminals of current.

4. The equipment as set forth in claim 1, characterized by forwarding a signal proportional to said current flowing through the heating tube and, similarly, the voltage drop along a given section of said heating tube to an absolute value forming unit and obtaining the integral of the absolute value of the signal taken over the period corresponding to the one cycle of network frequency at the output of an integrator, sampled by a sample and hold circuit.

5. The equipment as set forth in claim 1, characterized by ensuring temperature adjustment of said heating tube at starting and stopping the drawing-through of said coiled tungsten filament by power input control performed by power pulses of given magnitude and duration applied to, and removed from, said heating tube, whereas, subsequent maintenance of the adjusted temperature is achieved by temperature control preferably by means of digital PI regulation.

6. The equipment as set forth in claim 1, characterized by determining said required measuring current and said voltage drop produced by it for calculating "cold" resistance of said heating tube by making said power unit feed a voltage pulse into said heating tube during the period of measurement.

7. The equipment as set forth in claim 1, characterized by providing indication of said cold resistance of said heating tube on reaching a preset value in the course of prolonged use, upon which a worn-out one of said heating tubes is to be replaced.

8. The equipment as set forth in claim 1, characterized by said heating tube being surrounded by two heat reflecting metallic mirrors, a ceramic ring and a cooling coil for reducing intensity of heat radiation and for cooling.

9. An equipment for a continuous heat treatment of a coiled tungsten filament wound on a molybdenum core, comprising (a) advancing means for forwarding the filament in a feeding direction;

(b) a first tube through which the filament passes; said first tube having an open end forming an outlet for the filament from the first tube;

(c) means for heating said first tube to a first temperature;

(d) means for introducing humid hydrogen into said first tube;

(e) a second tube through which the filament passes; said second tube having an open end forming an inlet for the filament into the second tube; said second tube being situated downstream of said first tube as viewed in said feeding direction;

(f) means for heating said second tube to a second temperature;

(g) means for introducing dry hydrogen into said second tube;

(h) a generally vertically oriented hood having a closed top and an open bottom and surrounding the first and second tubes; the open end of the first tube and the open end of the second tube merging into an upper space within said hood; and (i) means for guiding the filament out of said hood through the open bottom thereof.

10. An equipment as defined in claim 9, wherein said first and second tubes are arranged parallel to one another and oriented vertically; further comprising an inverting wheel situated in said upper space within said hood between wheel situated in said upper space within said hood between the open ends of the first and second tubes for supporting the filament and changing travelling direction thereof.

* * * * *